US010907305B2

(12) United States Patent
Yekutiely

(10) Patent No.: US 10,907,305 B2
(45) **Date of Patent: *Feb. 2, 2021**

(54) SYSTEM AND METHOD FOR REPRINTING ON PAPER

(71) Applicant: REEP TECHNOLOGIES LTD., Petah Tikva (IL)

(72) Inventor: Barak M. Yekutiely, Kochav Yair (IL)

(73) Assignee: REEP TECHNOLOGIES LTD., Petah Tikva (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/661,013

(22) Filed: Jul. 27, 2017

(65) Prior Publication Data

US 2017/0335518 A1 Nov. 23, 2017

Related U.S. Application Data

(60) Continuation-in-part of application No. 14/938,872, filed on Nov. 12, 2015, now Pat. No. 9,816,234, (Continued)

(51) Int. Cl.

| | |
|---|---|
| ***D21H 19/20*** | (2006.01) |
| ***D21H 21/14*** | (2006.01) |
| ***B41M 7/00*** | (2006.01) |
| ***D21H 13/36*** | (2006.01) |
| ***D21H 27/00*** | (2006.01) |

(Continued)

(52) U.S. Cl.

CPC ..... *D21H 19/20* (2013.01); *B41J 11/002* (2013.01); *B41M 7/0009* (2013.01); *D21H 13/36* (2013.01); *D21H 21/14* (2013.01); *D21H 27/00* (2013.01); *B41J 29/26* (2013.01)

(58) Field of Classification Search

None

See application file for complete search history.

(56) References Cited

U.S. PATENT DOCUMENTS 3,464,534 A 9/1969 Muncheryan
4,732,786 A * 3/1988 Patterson ..... B41M 5/52 347/105

(Continued)

FOREIGN PATENT DOCUMENTS

CN 101073957 A 11/2007
GB 2490229 A 10/2012

(Continued)

OTHER PUBLICATIONS

"Ceramic Fibers", Report on Carcinogens, Fourteenth Edition, 2 pages, no date, [onl ine], retrieved from the Internet, [retrieved Mar. 16, 2017], <U RL:https ://ntp.niens n. ih.gov/ntp/roc/content/profiles/ceram icfibers.pdf.

*Primary Examiner* — Dennis R Cordray
(74) *Attorney, Agent, or Firm* — Soroker Agmon Nordman

(57) ABSTRACT

An enhanced paper for printing, including a substrate, an ablation resistant coating applied to the substrate, wherein the enhanced paper is ablation resistant so that it is not damaged by a light beam that illuminates enhanced paper with a fluence that ablates ink or toner but would damage standard printing paper that is made from cellulose fiber and is non-ablation resistant; and wherein the enhanced paper has physical properties of the standard printing paper for printing with laser printers and ink printers.

9 Claims, 7 Drawing Sheets

Related U.S. Application Data which is a division of application No. 14/407,968, filed as application No. PCT/IL2014/050187 on Feb. 20, 2014, now Pat. No. 9,216,592.

(51) Int. Cl.
*B41J 11/00* (2006.01)
*B41J 29/26* (2006.01)

(56) References Cited

U.S. PATENT DOCUMENTS

| | | | | |
|---|---|---|---|---|
| 5,024,968 | A | 6/1991 | Engelsberg | |
| 5,320,897 | A | 6/1994 | Kondo | |
| 5,614,339 | A * | 3/1997 | Tankovich | B08B 7/0042 430/19 |
| 5,958,268 | A * | 9/1999 | Engelsberg | B08B 7/0042 134/1 |
| 6,698,880 | B1 | 3/2004 | Campbell | |
| 6,942,919 | B2 | 9/2005 | Tokiyoshi | |
| 7,160,608 | B2 | 1/2007 | Yanagisawa | |
| 7,553,395 | B2 | 6/2009 | Stoffel | |
| 7,732,373 | B2 | 8/2010 | Tatewaki et al. | |
| 2002/0122931 | A1 * | 9/2002 | Brownfield | B41M 5/262 428/324 |
| 2002/0171730 | A1 * | 11/2002 | Nakahara | B41M 5/502 347/105 |
| 2003/0003273 | A1 | 1/2003 | Izutani | |
| 2003/0008111 | A1 | 1/2003 | Yoshino | |
| 2003/0152752 | A1 | 8/2003 | Tokiyoshi | |
| 2007/0249736 | A1 * | 10/2007 | Watanabe | B41M 5/5218 516/81 |
| 2011/0037803 | A1 | 2/2011 | Bray et al. | |
| 2012/0219766 | A1 | 8/2012 | Gupta | |

FOREIGN PATENT DOCUMENTS

| | | | |
|---|---|---|---|
| JP | 52140605 | A | 11/1977 |
| WO | 9500343 | A1 | 1/1995 |

* cited by examiner

SYSTEM AND METHOD FOR REPRINTING ON PAPER

RELATED APPLICATIONS

This application is a continuation in part of application Ser. No. 14/938,872 dated Nov. 12, 2015, which originated from a divisional continuation of application Ser. No. 14/407,968 dated Dec. 15, 2014, the disclosures of which are incorporated herein by reference.

TECHNICAL FIELD

The present disclosure relates generally to paper for use with standard printers and more specifically to paper that can be erased and reused.

BACKGROUND

Regardless of the digitization of technology and the workplace, use of paper is growing on an annual basis. Global production in the pulp, paper and publishing sector is expected to increase by 77% from 1995 to 2020. A large majority of pages printed both at home and in the workplace are disposed of, either as trash or by recycling, the average lifespan of a print being less than 1 day. Thus, the amount of waste is enormous; about 700 pounds of paper are consumed by the average American every year. Although paper is not considered an expensive commodity, the economic impact of the sheer volume is tremendous; this is estimated at about 10000 pages per year per office employee.

Erasable paper and supporting printing systems provide an interesting alternative to standard paper. An erasable paper and supporting printing system allows printing information on either treated or plain paper with the capacity to erase the information from the paper, or for the information to disappear from the paper after a certain period, allowing the paper to be reused.

Generally erasable paper will be a paper treated with an overcoat which can undergo a photochromic, thermochromic or other transition which prints and erases when using specifically designed print systems. Photochromic papers print when irradiated at a specific wavelength, often in the UV range and erased when exposed to a different wavelength. A thermochromic paper would be printed by various methods including irradiation, mild heat, chemicals, etc. and erased when heated above a threshold temperature, typically above 100° C.

Many examples exist describing single use and multiple use of photochromic papers (e.g. XEROX in US 2011/0037803). RICOH and their subsidiaries disclose having designed a thermochromic paper wherein erasing is done either by heat or light (e.g. U.S. Pat. No. 7,732,373). TOSHIBA discloses having developed a heat sensitive thermoplastic toner. Wherein upon heating the thermoplastic toner particles flow forming a thin transparent layer (e.g. US 2011/0165507). CASIO describes developing a negatively charged toner that can be electrostatically removed from the paper using a device designed for doing so (e.g. US 2012/0264044). Hewlett Packard describes developing a print system and ink that is erasable using electrical erasing (e.g. U.S. Pat. No. 6,544,601).

Older methods include the use of solvent to remove toners, (e.g. IBM U.S. Pat. No. 4,413,266 and Cannon U.S. Pat. No. 6,379,001): The solvents may be organic, inorganic or mixtures and demand the use of soluble inks.

A problem with the above methods is that they require special printers, special toner or ink, leave markings on the paper or damage the paper, so that the paper can only be used a few times (e.g. 2-4).

In an article by David Ricardo Leal-Ayala, J. M. Allwood, M. Schmidt, and I. Alexeev, "Toner-print removal from paper by long and ultrashort pulsed lasers" (Proceedings of the Royal Society A: Mathematical Physical and Engineering Sciences, vol. 468. pp. 2272-2293. They disclose attempts to remove laser print toner from standard paper by using ultrafast long pulsed lasers to irradiate the toner particles and remove them from the paper. The process requires use of specific wavelengths with short pulse duration to minimize damage to the paper. They disclose having some success in vaporizing most of the toner on standard paper, so that the paper may be used up to two or three times.

In summary the current state of the art technology is essentially limited to:

1. Specifically designed paper, not compatible with standard printer systems
2. Specifically designed inks and toners that may or may not require special printers.
3. Specifically designed printers, usually with slower print times and higher costs per page than typical home and business printers
4. Paper often suffers discoloration after erasing.
5. Paper often suffers from deformation after erasing, typically curling, Paper is generally only reusable a limited number of times (e.g. less than ten).
6. Systems force offices to maintain two types of printing systems, one for storage and one which is erasable.

SUMMARY

An aspect of an embodiment of the disclosure relates to a system and method for creating enhanced paper for printing using standard printers. The enhanced paper can be erased using a light beam without damaging the enhanced paper so it may be used multiple times.

There is thus provided according to an exemplary embodiment of the disclosure, an enhanced paper for printing, comprising: a substrate; an ablation resistant coating applied to the substrate; wherein the enhanced paper is ablation resistant so that it is not damaged by a light beam that illuminates enhanced paper with a fluence that ablates ink or toner but would damage standard printing paper that is made from cellulose fiber and is non-ablation resistant; and wherein the enhanced paper has physical properties of the standard printing paper for printing with laser printers and ink printers.

In an exemplary embodiment of the disclosure, the physical properties are selected from the group consisting of: density, thickness, weight, tensile strength, tear resistance, burst strength, and smoothness.

Optionally, the substrate is selected from the group consisting of: fiber based materials, film based materials, organic based materials, inorganic based materials, metallic based materials and/or any combination thereof.

In an exemplary embodiment of the disclosure, the coating is selected from the group consisting of: organic based materials, inorganic based materials and/or metallic based materials, thus enabling a non-ablation substrate coated by the ablation resistant material, not to be damaged by a fluence that ablates toner or ink.

Optionally, the ablation resistant coating is produced from any material that reflects/refracts/absorbs and/or any combination thereof, light beams with wavelength and/or fluence that may ablate ink and/or toner.

In an exemplary embodiment of the disclosure, the enhanced paper maintains the same print quality as when using standard printing paper stock.

Optionally, the substrate is initially suitable for printing.

Alternatively, the substrate is initially unsuitable for printing.

There is further provided according to an exemplary embodiment of the disclosure, a method of creating enhanced paper for printing, comprising: receive an ablation resistant material; receive a substrate; forming an enhanced paper that is ablation resistant by coating or fusing the ablation resistant material to the substrate to form the enhanced paper so that the enhanced paper would not be damaged by a light beam that illuminates the enhanced paper with a fluence that ablates ink or toner but would damage standard printing paper that is made from cellulose fiber and is non-ablation resistant; and wherein the enhanced paper is the coated substrate having physical properties of the standard printing paper for printing with laser printers and ink printers.

In an exemplary embodiment of the disclosure, the physical properties are selected from the group consisting of: density, thickness, weight, tensile strength, tear resistance, burst strength, and smoothness.

Optionally, the substrate is selected from the group consisting of: fiber based materials, film based materials, organic based materials, inorganic based materials, metallic based materials and/or any combination thereof.

In an exemplary embodiment of the disclosure, the coating is selected from the group consisting of: organic based materials, inorganic based materials and/or metallic based materials, thus enabling the non-ablation substrate coated by the ablation resistant material, not to be damaged by a fluence that ablates toner or ink.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
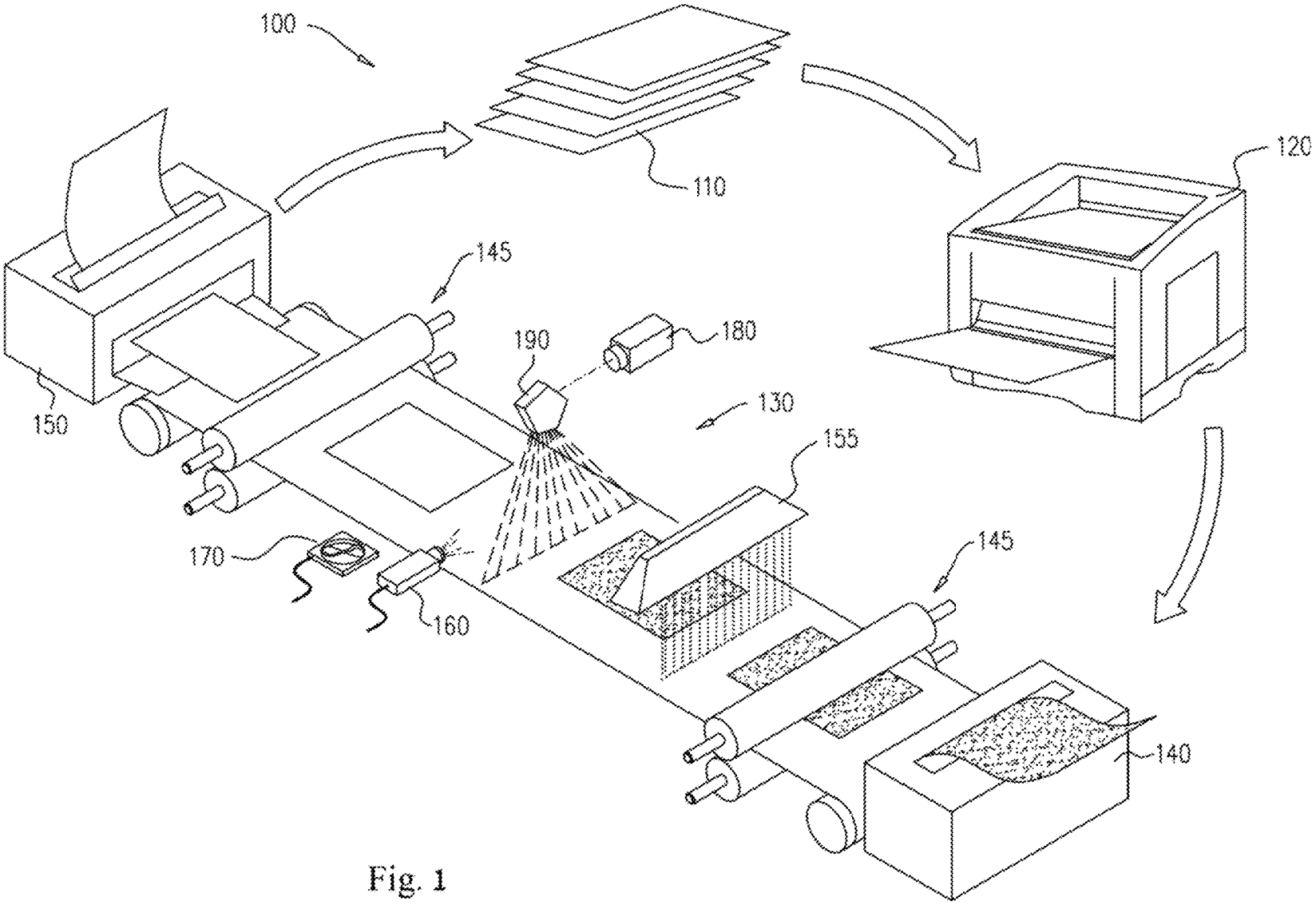
FIG. 1 is a schematic illustration of a system for reusing paper in standard printers, according to an exemplary embodiment of the disclosure.
Figure 2:
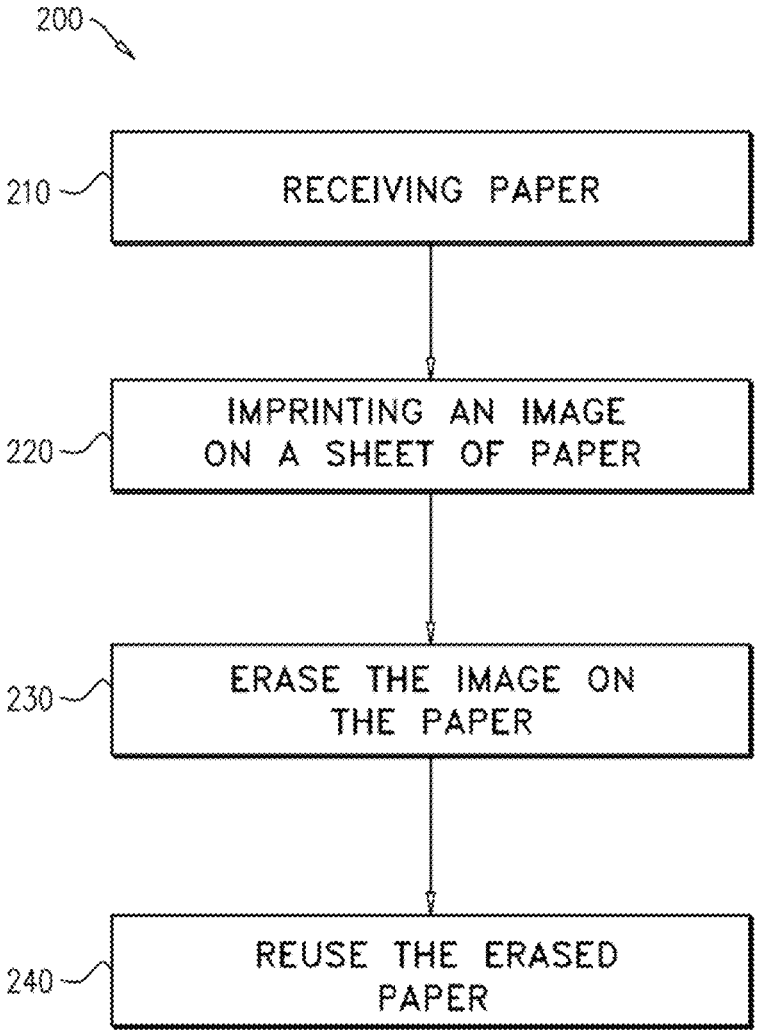
FIG. 2 is a flow diagram of a method of reusing paper in standard printers, according to an exemplary embodiment of the disclosure.

FIG. 1 is a schematic illustration of a system 100 for reusing paper in standard printers 120, according to an exemplary embodiment of the disclosure, and FIG. 2 is a flow diagram of a method 200 of reusing paper in standard printers 120, according to an exemplary embodiment of the disclosure.

In an exemplary embodiment of the disclosure, method 200 uses an alternative substrate that serves as the paper 110 for printing on with standard printers 120, for example ink jet and laser printers. The alternative substrate is provided in the form of standard printing paper 110, for example provided in reams of 500 A4 or letter pages having a thickness of between 0.07 mm (0.0028 in) to 0.18 mm (0.0071 in) and a weight between 60 to 120 grams per square meter ($g/m^2$). The paper is manufactured as explained below to withstand high temperatures, for example from intense laser radiation to ablate the ink on the surface of the paper without damaging the paper.

In an exemplary embodiment of the disclosure, a user receives (210) paper 110 (e.g. a ream of paper) for printing on with a standard home or office printer 120 such as manufactured by HP, XEROX, OKI, CANON, BROTHER, RICOH or other manufacturers. The paper may be A0, A1, A2, A3, A4, A5, Letter, Legal or any other standard size supported by the printer 120. Optionally, printer 120 can be a fax machine or copy machine in addition to or instead of a printer. In an exemplary embodiment of the disclosure, printer 120 imprints (220) an image on a sheet of paper 110. Optionally, images may be imprinted on both sides of the sheet of paper 110, for example by resubmitting the paper or using a duplex printer.

In an exemplary embodiment of the disclosure, once the user is finished with the paper, instead of shredding it or sending it to a recycling company, the user puts the paper into an input tray 140 of an erasing device 130 to erase (230) the image on the paper 110. The erasing device 130 will illuminate the paper, for example by scanning it with an intense laser beam from a laser source 180 via mirrors and lenses 190 causing the toner/ink forming the image on the paper 110 to be ablated. Once the paper 110 is erased it is output from the erasing device 130 to an output tray 150 and can then be reused (240) for forming a new image on it. Optionally, erasing device 130 may serve as a secure shredder, since it ablates the printed content/images on the paper 110.

Figure 3:
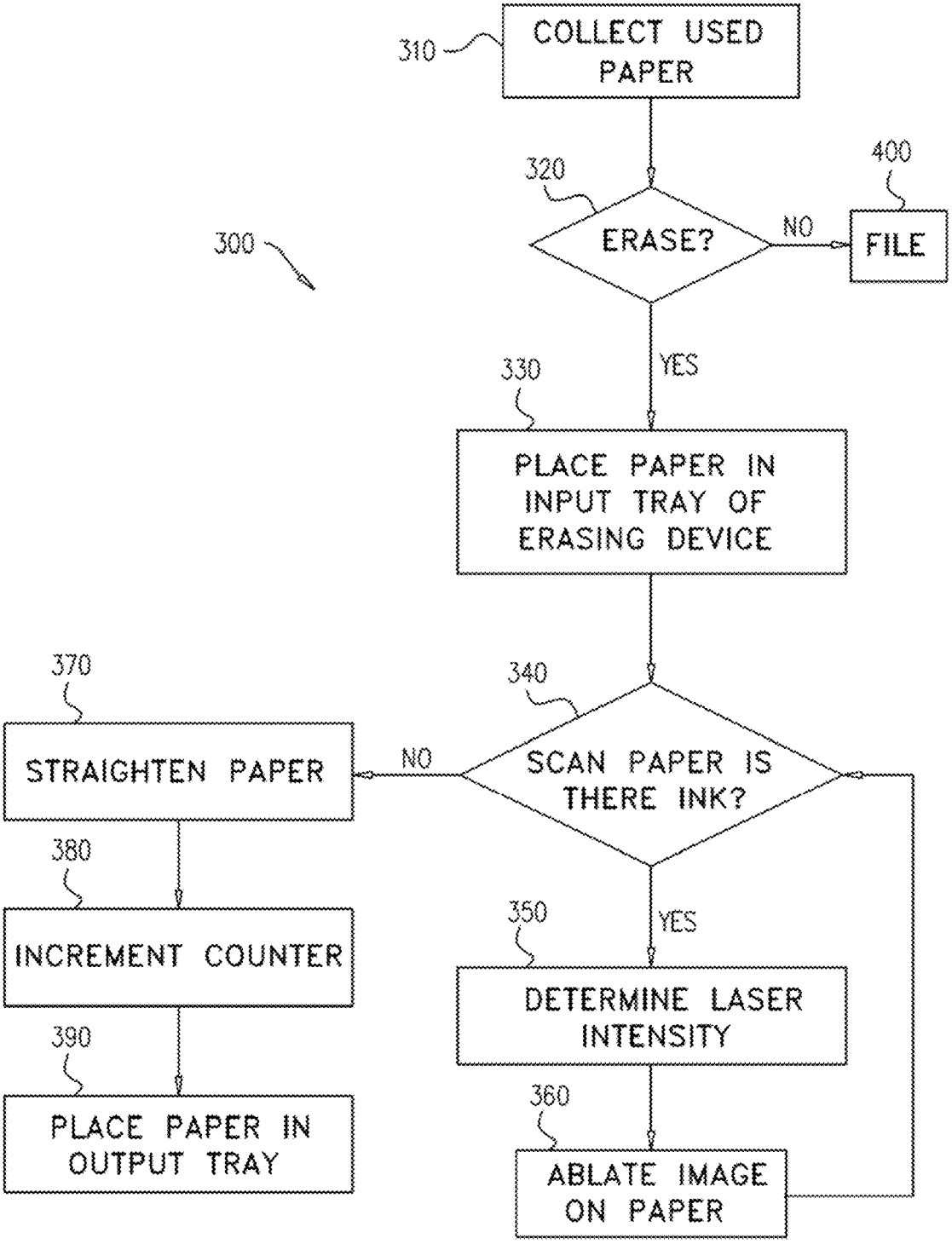
FIG. 3 is a flow diagram of an erasing process of printed paper, according to an exemplary embodiment of the disclosure.

FIG. 3 is a flow diagram of an erasing process 300 of printed paper 110, according to an exemplary embodiment of the disclosure. In an exemplary embodiment of the disclosure, the user collects (310) used paper sheets with images on them. The images may include text and drawings of any form. The user checks if the paper is needed or can be erased (320). If the paper is needed the paper can be filed (400) in the user's filing system. If however the user does not need the paper then the paper can be placed (330) in input tray 140 of erasing device 130 to be erased and reused instead of shredding the paper or sending it to a recycling company. In an exemplary embodiment of the disclosure, erasing device 130 may be automated and include rollers 145 for automatically grasping a paper and maneuvering it through erasing device 130. Optionally, erasing device 130 first scans (340) the paper 110 with an optical scanner 155 into a memory of erasing device 130 to analyze the content of the paper 110. In some embodiments of the disclosure, erasing device 130 can archive the content of all the documents that are erased, for example to allow retrieval of documents that were accidentally erased. Alternatively or additionally, erasing device 130 analyzes the scanned content of the paper to determine if there is an image that needs to be erased. If the paper contains an image, erasing device 130 may analyze the color, location and intensity of the image to determine (350) a wavelength, laser intensity, time duration and positioning for use in erasing the image. In an exemplary embodiment of the disclosure, different wavelengths or intensities are selected to erase different colored images. Optionally, erasing device 130 activates the laser source 180 and controls mirrors and lenses 190 to ablate (360) the image on paper 110. In some embodiments of the disclosure, erasing device 130 may include a fan 170 for blowing away dust and vapor of ink or toner particles that are released from the paper 110 during the ablation process.

In some embodiments of the disclosure, erasing device 130 scans (340) paper 110 again to make sure that the image was completely erased and repeats the ablation (360) process again if not. Alternatively, the ablation (360) process may be reliable and there is no need to rescan the content of paper 110 after ablation. Optionally, erasing device 130 may have an option of discarding pages that cannot be erased. In an exemplary embodiment of the disclosure, erasing device 130 may straighten (370) out papers 110 as they go through erasing device 130, for example by ironing them to remove creases and wrinkles and removing staples or dirt attached to the papers 110. Optionally, erasing device 130 includes a counter 160 that counts the number of papers 110 that are processed, for example to charge the user for every paper 110 that is erased. After erasing papers 110 they are output from erasing device 130 to output tray 150 so that they can be reused with printer 120. Optionally, papers that fail the erasing process, for example if they are torn or damaged so that they cannot be reused, will be output to a different tray.

In some embodiments of the disclosure, the ablation process may be performed by other methods, for example a heater unit that heats the entire page or a light source (e.g. a high energy light source) that heats the entire page. Optionally, a laser light beam with a wavelength of 355 nm, 532 nm or 1064 nm or wavelengths with values in between these values or a combination of wavelengths can be used. In an exemplary embodiment of the disclosure the laser beam illuminates points on the paper with a fluence of 1.6 $J/cm^2$ or higher. Alternatively, a lower intensity beam may be used for longer time durations to heat the paper to a desired temperature. Optionally, different wavelengths and fluences may used for different colors and/or different types of inks/toners.

In an exemplary embodiment of the disclosure, erasing paper 110 may be done either by a broad beam laser light covering the entire Sheet surface or a portion of the Sheet surface or a spot specific scanning laser. Optionally, multiple scans with the laser beam may be performed to ensure erasing. In an exemplary embodiment of the disclosure, every point on paper 110 may be subject to heat levels exceeding 100° C., 200° C., 600° C. or even 1200° C. yet due to the type of paper being used the paper will not show signs of deformation or thermal discoloration and no oxidative damage either.

The quality of erasability can be assessed on a macroscopic and microscopic level. Macroscopically, the Sheet will return to its original optical density, within a Delta E of less than 0.2, in other embodiments with a Delta E of less than 0.5. Wherein Delta E represents the color difference between areas on the paper as defined by the International Commission on Illumination (CIE).

On a microscopic level, after the erasing process the paper 110 will contain less than 1 ink or toner resin particle per square inch and in another embodiment less than 5 ink or toner resin particles per square inch. After the erasing process if there is any damage to the paper surface it should be such that the paper properties and print quality remain within the specifications of the paper.

Three exemplary methods are disclosed below for forming enhanced paper having a temperature stable matrix, which when exposed to high temperatures will ablate the ink or toner on the paper surface without damage to the paper. The three methods are exemplified by FIGS. 4-6. Optionally, the papers formed by the three methods are substantially free from wood fibers, lignin and cellulose or include less than 5% of such fibers so that the papers will not turn yellow. In an exemplary embodiment of the disclosure, the enhanced paper may also serve for long term archiving since it is less susceptible to discoloration due to heat and age and less affected by the components of the ink or toner, which may include acids.

Figure 4:
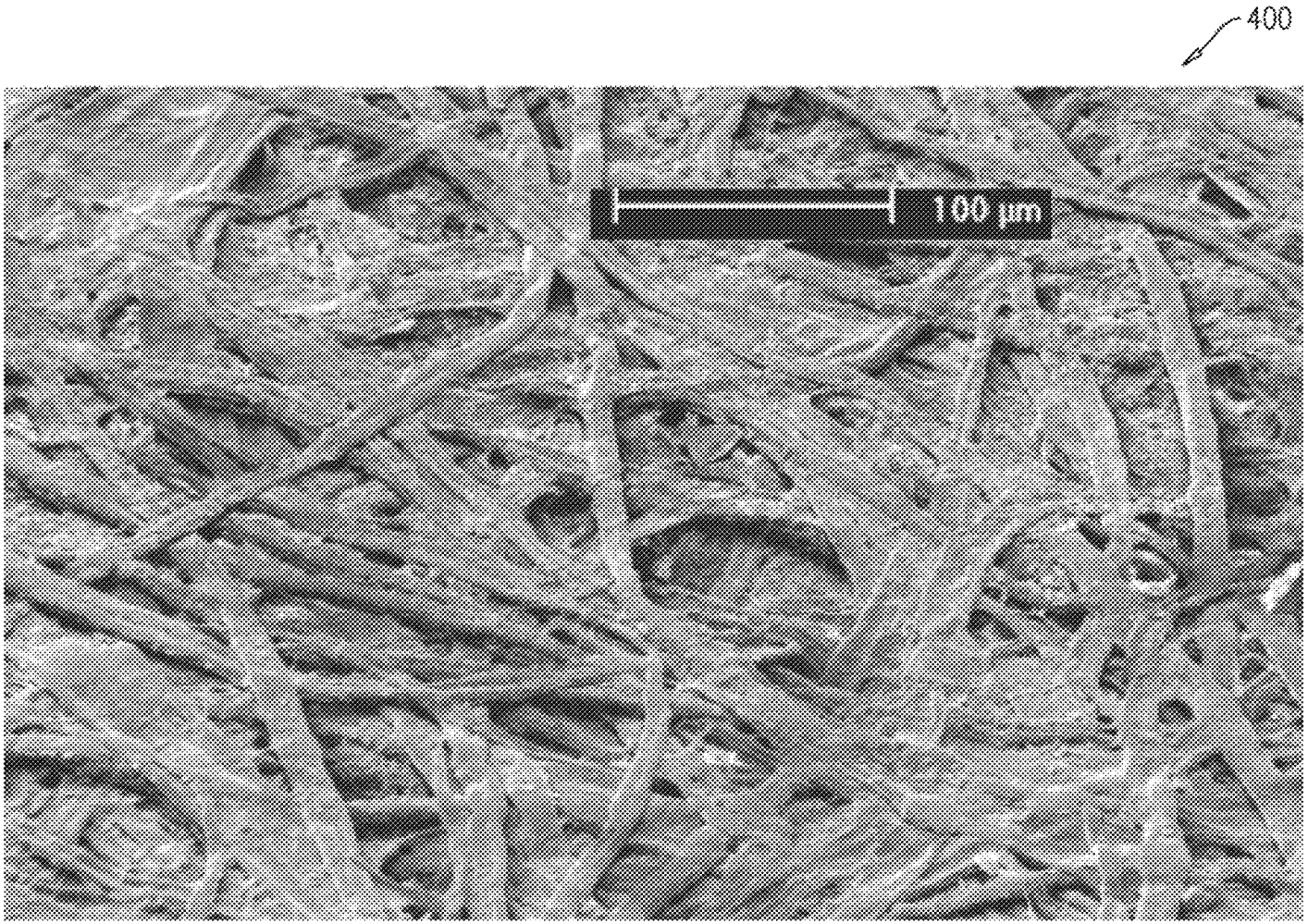
FIG. 4 is a schematic illustration of a magnified view of ceramic fiber paper, according to an exemplary embodiment of the disclosure.

FIG. 4 is a schematic illustration of a magnified view 400 of ceramic fiber paper, according to an exemplary embodiment of the disclosure. In an exemplary embodiment of the disclosure, ceramic fibers are used instead of organic fibers such as wood or other fibers containing cellulose in the process of creating standard paper. Optionally, at least 95% of the fibers are ceramic fibers without cellulose. Ceramic paper will generally maintain its physical properties, specifically strength related properties, better than standard paper.

In an exemplary embodiment of the disclosure, the selection of an appropriate ceramic material will enable a sheet of paper manufactured by this method to maintain stability at high temperatures, for example up to and exceeding 1200° C. Optionally, the temperature stability may be limited by chemical additives rather than by the ceramic material. In an exemplary embodiment of the disclosure, the ceramic fibers are designed by chemistry or by production methods (e.g. chemical pulping or mechanical pulping) to have a similar size as the standard cellulose fibers that are being replaced. Optionally, the production method is similar to the production of standard paper, for example, the use of additives such as binders, optical brighteners, pigments and surface treatments are the same.

In an exemplary embodiment of the disclosure the ceramic fiber paper is produced with similar thickness as standard printing paper. In a preferred embodiment, the ceramics used may be pure metal oxide, e.g. alumina, silica, magnesia, calcia, titania and/or mixtures thereof. In another embodiment, the ceramics may be mineral based e.g. Cordierite, Andalusite, Kyanite, Anorthite, Albite, Jadeite, Titanite. In an exemplary embodiment the fibers are fused, in other embodiments the fibers are partially fused or unfused. Binders may be used; the binders may include PCC (precipitated calcium carbonate), clay, kaolin or others known in the art. Pigments may be used; typically this will be titanium dioxide, or others. Optical brighteners may be used; this may include inorganic materials, e.g. barium aluminate, barium magnesium aluminate, strontium aluminates, strontium phosphates.

Figure 5A:
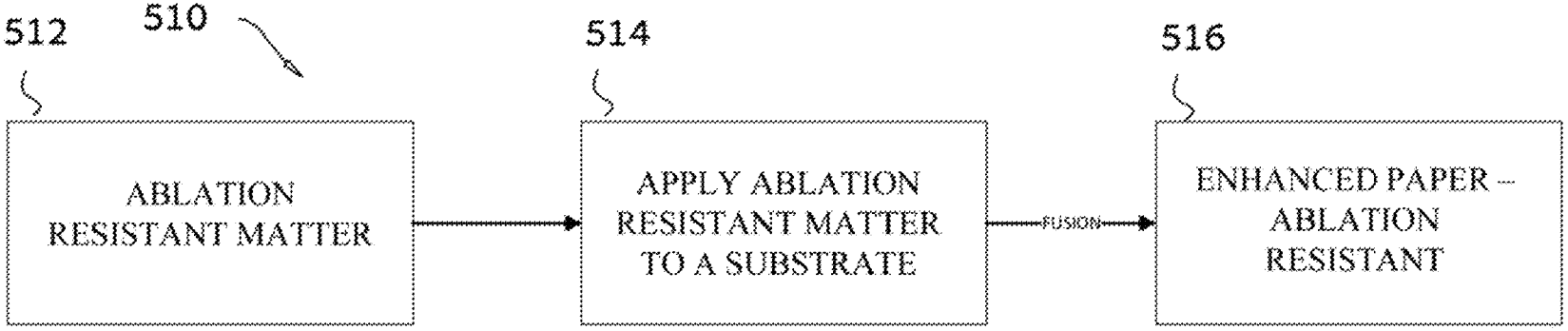
FIG. 5A is a schematic illustration of a process of manufacture of enhanced paper, according to an exemplary embodiment of the disclosure.

FIG. 5A is a schematic illustration 510 of a process of manufacture of enhanced paper, according to an exemplary embodiment of the disclosure. As indicated in block 512, an ablation resistant matter of any kind may be selected, the coating material may be of any kind e.g. organic, inorganic and/or metallic based materials as long as the resulting product, the enhanced paper, is ablation resistant, so that it is not damaged by a fluence that ablates toner or ink. The ablation resistant coating may be produced from any material that optimally reflects, refracts, absorbs and/or any combination thereof of a light beam with a wavelength and/or fluence that may ablate ink and/or toner. As indicated in block 514, the enhanced paper may be produced by coating a substrate, with an ablation resistant material of any kind, for example, by coating a fiber based material of any kind with an ablation resistant material of any kind. The coated substrate for forming the enhanced paper may be of any kind, for example fiber based materials, film based materials, organic based materials, inorganic based materials, metallic based materials and/or any combination thereof as long as the substrate can be used for printing in standard laser printers and/or inkjet printers (e.g. standard printing paper), before being coated and at least after being coated. As indicated in block 516, the ablation resistant matter may be applied to any substrate, for example by fusing the two together, so as to form an enhanced paper which is ablation resistant. Accordingly coating the substrate produces an enhanced paper wherein the substrate of the enhanced paper is protected from damage when ablating ink or toner from the enhanced paper.

In an exemplary embodiment of the disclosure, the enhanced paper may be any fiber based substrate coated by a film based ablation resistant material, thus transforming a non-ablation substrate into an ablation resistant enhanced paper.

The enhanced paper produced by coating a substrate with a film based ablation resistant material is required to exhibit the qualities of standard printing paper so that the enhanced paper may be used for printing, using a standard laser and/or an ink printer. In an exemplary embodiment of the disclosure, the substrate initially exhibits the qualities of standard printing paper and retains these qualities after being coated. Alternatively, the substrate may initially not be usable as a standard printing paper but will be usable as a standard printing paper after being coated, for example the coating may produce enhanced paper that is more flexible and/or the coating may cause the enhance paper to accept ink or toner even if the substrate initially did not accept ink or toner.

It should be noted that the ablation resistant coating process may be applied to a standard paper production process and/or that the ablation resistant coating is applied to an existing paper of any kind.

Figure 5B:
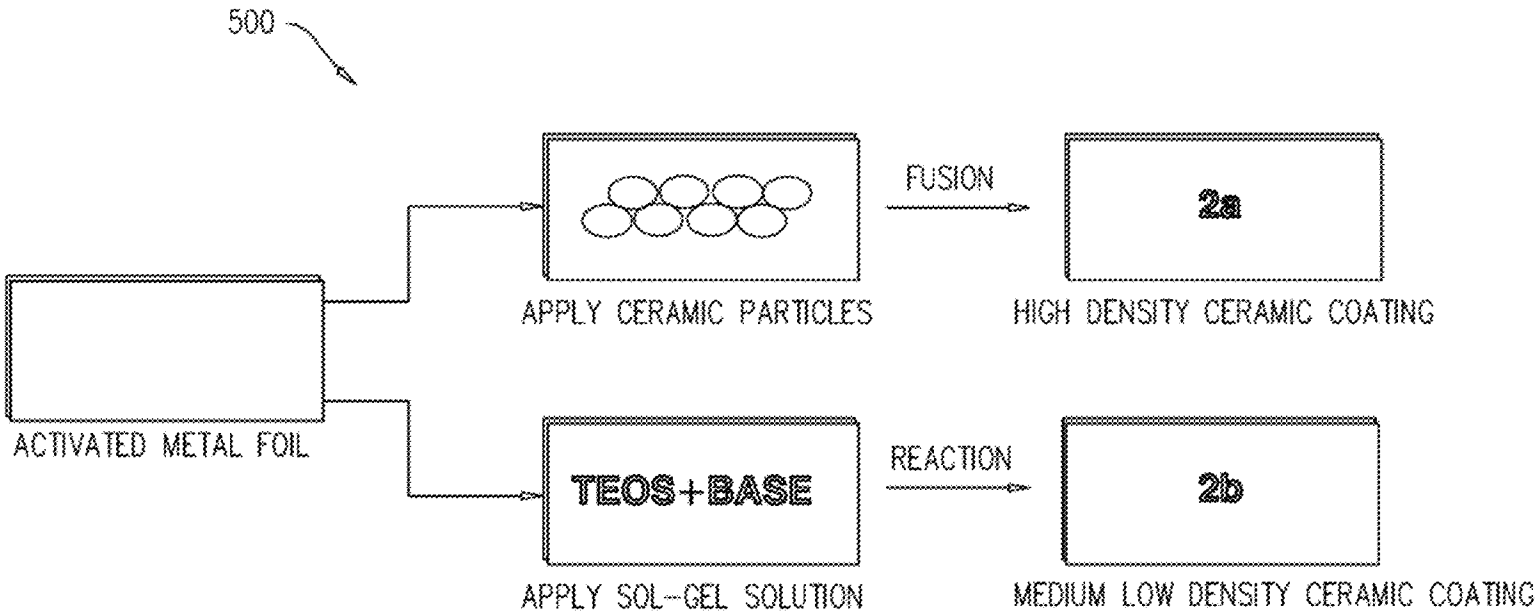
FIG. 5B is a schematic illustration of a process of manufacture of a ceramic coated metal foil paper, according to an exemplary embodiment of the disclosure.

FIG. 5B is a schematic illustration 500 of the manufacture of ceramic coated metal foil paper, according to an exemplary embodiment of the disclosure.

In an exemplary embodiment of the disclosure, the Sheet of paper 110 may be a ceramic coated metal foil. The general process for the preparation of this embodiment of the Sheet is as follows: a thin metal foil is surface activated and its surface area is increased. Afterwards, a thin layer of ceramic material is fixed on the active surface. The ceramic material may be further fired in order to increase hardness and prevent dusting.

In an exemplary embodiment of the disclosure, the metal foil may be any temperature stable metal foil, temperature stability being defined as not undergoing any change in physical shape or in chemistry at temperatures above 500 C, or above 750 C, or above 1000 C or even above 1250 C. In an exemplary embodiment of the disclosure, the foil will be aluminum. In other embodiments, the foil will be steel, chrome, brass, tin or a mixture thereof. In an exemplary embodiment the foil is thinner than 0.05 mm. Alternatively, the foil may only be thinner than 0.1 mm. Surface activation of the metal foil can be by surface oxidation, plasma oxidation, plasma coating, or other methods which will increase the surface energy or the surface area of the foil. Surface area increase will typically be by surface roughening either by particle blasting or particle abrasion; other methods may also be used.

In an exemplary embodiment of the disclosure, the ceramic coating can be applied on the surface of the metal foil at varying thicknesses and fused at high temperatures. This method will develop a high density coating. In a preferred embodiment, ceramics used may be pure metal oxide, e.g. alumina, silica, magnesia, calcia, titania or mixtures thereof. In another embodiment, the ceramics may be mineral based e.g. Cordierite, Andalusite, Kyanite, Anorthite, Albite, Jadeite, Titanite or others. In an exemplary embodiment of the disclosure, the ceramic material may be fused, in other embodiments the fibers may be partially fused and partially unfused. Binders may be used; the binders may include PCC (precipitated calcium carbonate), clay, kaolin or others. Pigments may be used; typically this will be titanium dioxide or others. Optical brighteners may be used; this may include inorganic materials, e.g. barium aluminate, barium magnesium aluminate, strontium aluminates, strontium phosphates. In an alternative embodiment, the ceramic material can be coated on the metal foil by the Sol-Gel method. The Sol gel method uses activated ceramic precursor molecules, e.g. tetraethoxysilane (TEOS) in the presence of base and water to form the ceramic matrix. Using the Sol-Gel method allows for the control of the density. In an exemplary embodiment of the disclosure, ceramics used may be pure metal oxide precursor, e.g. TEOS, tetramethoxysilate and other silica precursors or similar precursors from alumina, magnesia, calcia, titania or mixtures thereof. Optionally, binders may be added to the Sol-gel matrix. The binders may include PCC (precipitated calcium carbonate), clay, kaolin, or others. Pigments may be added to the Sol-gel matrix; typically this will be titanium dioxide or others. Optical brighteners may be added to the Sol-gel matrix, this may include inorganic materials e.g. barium aluminate, barium magnesium aluminate, strontium aluminates, strontium phosphates.

Figure 6:
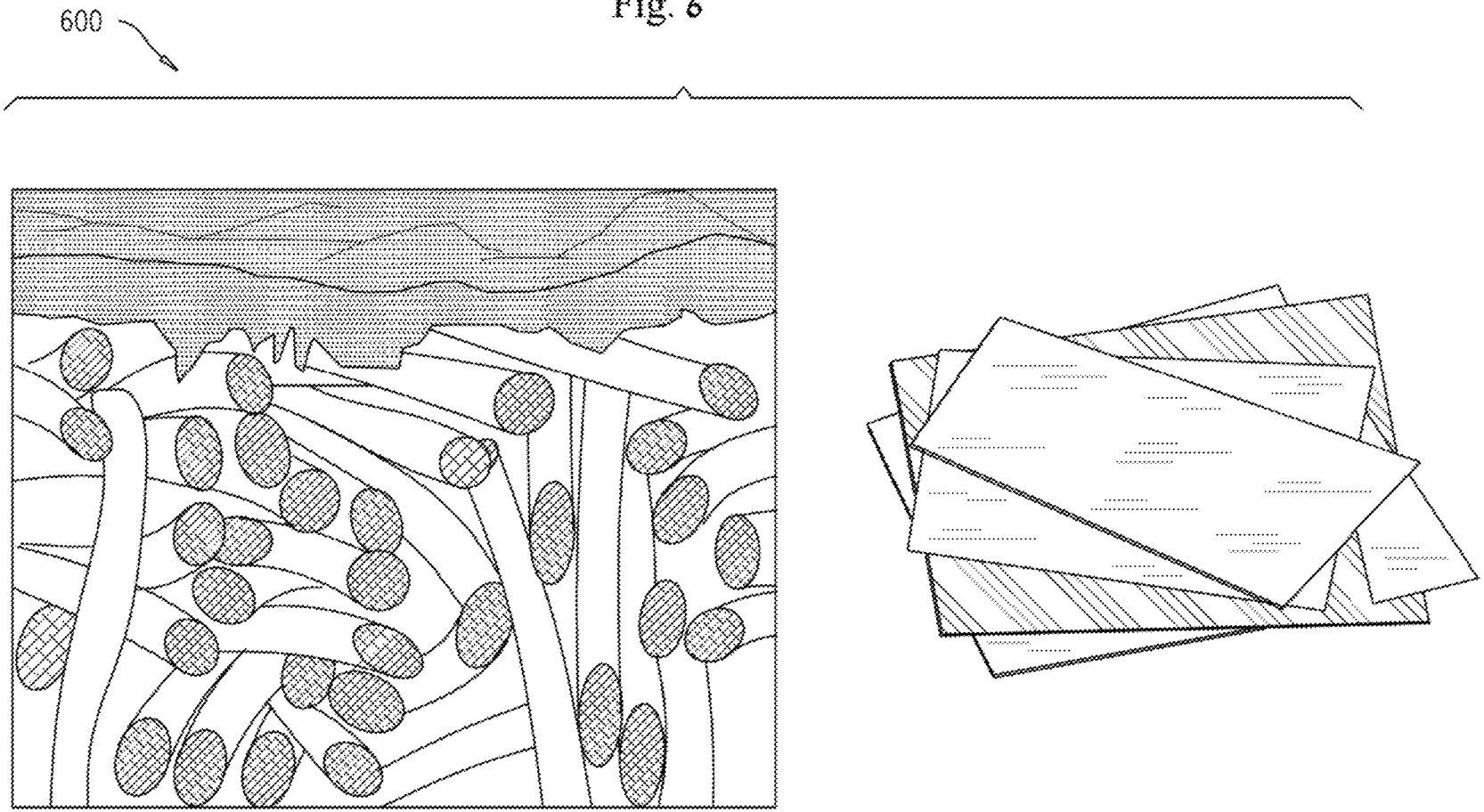
FIG. 6 is a schematic illustration of an expanded view of polymer fiber or polymer film paper, according to an exemplary embodiment of the disclosure.

FIG. 6 is a schematic illustration of a magnified view 600 of polymer fiber or polymer film paper, according to an exemplary embodiment of the disclosure. In an exemplary embodiment of the disclosure, the sheets of paper 110 are based on a polymer matrix. In a preferred embodiment, the system will be based on a polymer fiber system wherein polymer fibers are used in lieu of cellulose or wood fibers. The selected polymer is stable at high temperatures, e.g. above 600° C. for long term stability and higher temperatures, e.g. 1200° C. for very short periods. In an exemplary embodiment of the disclosure, the polymer fibers are fluoropolymers, e.g. polytetrafluoroethylene (PTFE, Teflon), polytrifluroethylene, polydifluoroethylene, polymonofluoroethylene and copolymers thereof. In some embodiments of the disclosure, the polymers can be bromopolymers, or chloropolymers. Optionally, other polymers can also be used. The Sheet may be prepared as a fibrous system, using, in an exemplary embodiment, partial crosslinking. In other embodiments, no crosslinking or high crosslinking may be used. Optionally, binders may be used; the binders may include PCC (precipitated calcium carbonate), clay, kaolin, or others. Optionally, pigments may be used; typically this will be titanium dioxide or other pigments. Optical brighteners may be used, this may include inorganic materials e.g. barium aluminate, barium magnesium aluminate, strontium aluminates, strontium phosphates.

In an exemplary embodiment of the disclosure, the sheet may be a polymer film. Optionally, the polymer film is selected so that it is stable at high temperatures, e.g. above 600° C. for long term stability and higher temperatures, e.g. 1200° C. for very short periods. Optionally, the polymer film is made from fluoropolymers, e.g. polytetrafluoroethylene (PTFE, Teflon), polytrifluroethylene, polydifluoroethylene, polymonofluoroethylene and copolymers thereof. In other embodiments the polymers are bromopolymers, or chloropolymers. Optionally, other polymers can also be used. In an exemplary embodiment of the disclosure, pigments are added to the polymer film; e.g. titanium dioxide or other pigments. Optionally, optical brighteners may be used, this may include inorganic materials e.g. barium aluminate, barium magnesium aluminate, strontium aluminates, strontium phosphates. The polymer film may be prepared, by extrusion. Furthermore, the polymer film may be treated to effect the surface area, e.g. by gravuring.

In an exemplary embodiment of the disclosure, the sheet of paper is designed to maintain the look, feel and physical properties of standard printing paper or in fact improve on them. The paper can be in certain embodiments a fiber or fiber-like based system wherein the general properties of paper including weight, density, thickness, flexibility, foldability, brightness and gloss. The Sheet will be made so as to maintain a large list of paper specifications. A list of the specifications can be: whiteness, tensile strength, tear resistance, burst strength, smoothness, contact angle and bending or a subset thereof. Additional specifications may also be added. The specifications can be in the machine direction (MD) or in the cross direction (CD) or both.

The Sheet is designed to use existing printing systems, inks and toners. Therefore, it will be designed to maintain the same print quality as the print systems maintain on regular paper stock. A short list of initial specifications can be color saturation, color coordinates, trap, ink picking, rub resistance, dot size and dot gain, or a subset thereof. Additional specifications may be added.

It should be noted that existing ceramic paper is not manufactured by the methods described above. The existing ceramic paper does not have the physical properties of standard printing paper and is not designed to be printed on using standard laser and ink printers. The quality of printing on ceramic paper is generally poor, for example being blurry and tending to smear. Existing ceramic paper is used generally for heat sealing, insulation, lining, and shock absorption. In contrast the enhanced paper manufactured by the methods described above is manufactured to have density, thickness, weight, tensile strength, tear resistance, burst strength, smoothness and other physical properties of standard printing paper. For example a standard A4 paper for printing will have properties such as:

1. A density (GSM) between 80 to 320, for example 160.
2. A thickness (mm) between 0.1 to 0.3, for example 0.2.
3. A Weight (grams) between 5 to 20, for example 10.
4. Whiteness (% of ISO 11475) 75 to 90, for example 80.
5. Tensile strength MD (Tappi T541) between 40 to 100, for example 70.
6. Tensile strength CD (Tappi T541) between 40 to 100, for example 40.
7. Tear resistance MD (mN) (Tappi T414) between 500 to 700, for example 600.
8. Tear resistance CD (mN) (Tappi T414) between 500 to 700, for example 600.
9. Burst strength (Kpa) (Tappi T403) between 200 to 300, for example 250.
10. Smoothness (ml/min) (ISO 8751-2) between 100 to 300, for example 300.
11. Bending MD (mN m) (Tappi T556) between 20 to 40, for example 39.
12. Bending CD (mN m) (Tappi T556) between 20 to 40, for example 17.

Additionally, the enhanced paper and standard printing paper have print quality properties related to color saturation, color coordinates, trap, ink picking, rub resistance and dot size/dot gain that differ from those of ceramic paper that is not manufactured for printing.

In an exemplary embodiment of the disclosure, the enhanced paper can also be manufactured by a sintering process using ceramic materials, for example by sintering 3 mol % Yttria-stabilized Zirconia in combination with other ceramic materials to form a paper suitable for printing.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove.

I claim:

1. A method of creating enhanced paper for printing, comprising:

receiving an ablation resistant material;

receiving a substrate;

forming an enhanced paper that is ablation resistant by coating or fusing the ablation resistant material to the substrate to form the enhanced paper;

testing a sample enhanced paper by illuminating the enhanced paper with a light beam having a fluence that ablates ink and toner but that would damage paper that was not enhanced, to verify that the enhanced paper is ablation resistant; and wherein the enhanced paper has physical properties that enable the enhanced paper to be used for printing with laser printers and ink printers.

2. A method according to claim 1, wherein the physical properties are selected from the group consisting of: density, thickness, weight, tensile strength, tear resistance, burst strength, and smoothness.

3. A method according to claim 1, wherein the substrate is selected from the group consisting of: fiber based, materials, film based materials, organic based materials, inorganic based materials, metallic based materials and/or any combination thereof.

4. A method according to claim 1, wherein the coating is selected from the group consisting of: organic based materials, inorganic based materials and/or metallic based materials, thus enabling the non-ablation resistant substrate coated by the ablation resistant material, not to be damaged by a fluence that ablates toner or ink.

5. A method according to claim 1, wherein the ablation resistant coating is produced from any material that reflects/refracts/absorbs and/or any combination thereof, light beams with wavelength and/or fluence that may ablate ink and/or toner.

6. A method according to claim 1, wherein the enhanced paper maintains the same print quality as when using standard printing paper stock.

7. A method according to claim 1, wherein the substrate is initially suitable for printing as a non-ablation resistant media.

8. A method according; to claim 1, wherein the substrate is suitable for printing only after applying the coating.

9. A method according to claim 1, wherein the substrate is standard printing paper.

* * * * *